US005618067A

United States Patent [19]

Carlson et al.

[11] Patent Number: 5,618,067

[45] Date of Patent: Apr. 8, 1997

[54] TILT LATCH DEVICE

[75] Inventors: Dennis Carlson, McPherson, Kans.; Jeffrey B. Hersh, Wayne, Pa.; Dennis Westphal, Parma, Mich.

[73] Assignee: CertainTeed Corporation, Valley Forge, Pa.

[21] Appl. No.: 478,607

[22] Filed: Jun. 7, 1995

[51] Int. Cl.[6] ..... E05C 1/10

[52] U.S. Cl. ..... 292/175; 292/337

[58] Field of Search ..... 292/164, 175, 292/DIG. 38, 337; 49/161

[56] References Cited

U.S. PATENT DOCUMENTS

| | | | |
|---|---|---|---|
| 4,622,778 | 11/1986 | Simpson | 49/161 |
| 4,669,765 | 6/1987 | Ullman | 292/175 X |
| 4,837,975 | 6/1989 | Simpson | 292/175 X |
| 5,096,240 | 3/1992 | Schultz | 292/DIG. 38 X |
| 5,121,951 | 6/1992 | Harbom et al. | 292/175 |
| 5,139,291 | 8/1992 | Schultz | 292/337 X |
| 5,165,737 | 11/1992 | Riegelman | 292/175 X |

OTHER PUBLICATIONS

Ashland Products Trade Literature entitled "Single & Double Hung Slider Casement", Ashland Products, Chicago, Illinois, undated.

*Primary Examiner*—Rodney M. Lindsey
*Attorney, Agent, or Firm*—Duane, Morris & Heckscher

[57] ABSTRACT

This invention provides a tilt latch device including a housing containing a spring-loaded latch member disposed therein which is designed to selectively extend from the housing. The device includes a snap fastener disposed to secure the housing to a first surface of a window sash or panel. Windows including such a device are also disclosed.

22 Claims, 3 Drawing Sheets

TILT LATCH DEVICE

FIELD OF THE INVENTION

Figure 1:
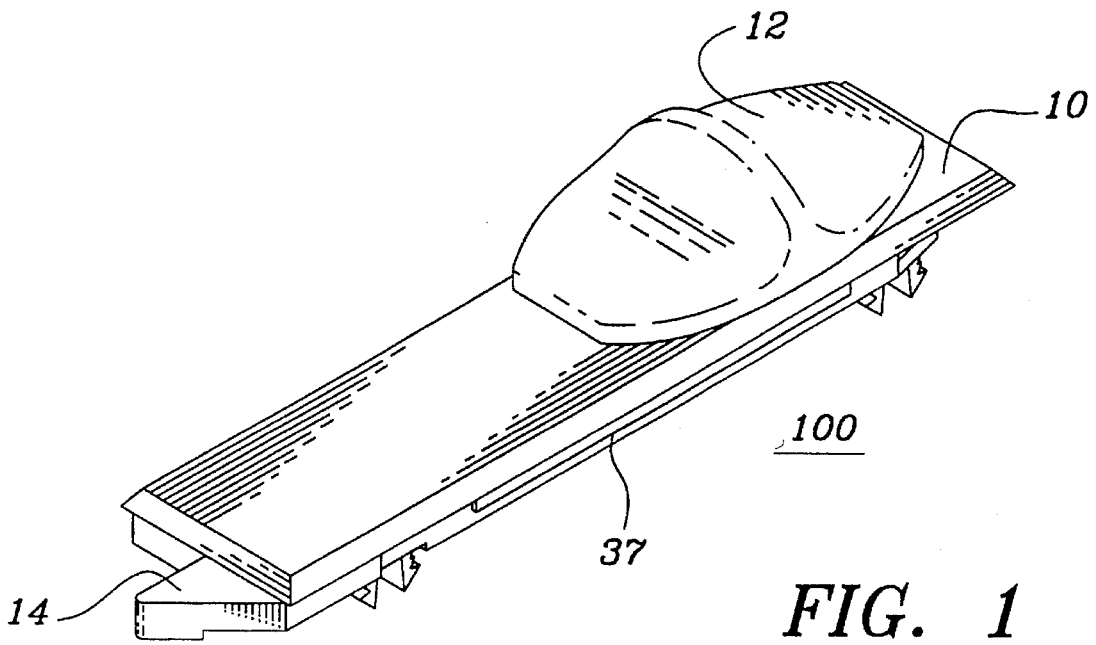

This invention relates to latching devices for windows, and in particular, to tilt latches for securing window panels and sashes to a window frame so that they can be selectively tilted out for cleaning and other purposes.

BACKGROUND OF THE INVENTION

Many modern windows now include vinyl-clad aluminum extrusion or vinyl-clad wooden frames and sashes. A recent trend is to provide the lower sash of double-hung windows with a pair of tilt latches mounted along the top rail. These tilt latches fall into two basic categories, top mount tilt latches and internal tilt latches.

Top mount tilt latches come pre-assembled and include a spring mounted latch within a cover or housing. The housing is mounted to the rail of the lower sash with two or four set screws. Since two tilt latches are provided on such windows, on both the left and right sides of the rail of the lower sash, up to four or more screws are required per sash.

Internal tilt latches are typically inserted within the aluminum or vinyl extrusion of the windows in a preconfigured cavity. Of course, considerable care must be used in constructing the window to provide a suitable internal structure for accommodating such a device.

While the most recent specimens for tilt latches have proven effective in securing tilt windows in place, the cost associated with a large number of set screws and the manufacture of internal window cavities has limited the affordability of such devices.

SUMMARY OF THE INVENTION

The present invention provides a window tilt latch device which can be mounted to a framed, hinged glass panel, such as the lower sash of a double-hung window. This tilt latch device includes a housing and a latch member disposed to extend selectively from the housing. The device further includes a snap fastener disposed to secure the housing to a first surface of the framed, hinged glass panel.

Accordingly, this invention can eliminate the four to eight screws currently used to attach top mount tilt latches to windows. The housing and snap fastener of this invention can be molded in a one-piece construction so as to minimize the number of parts, and further reduce costs. These tilt latches can be mounted on the top rail of the lower sash of double-hung windows merely by making one or two holes in the rail surface for receiving the snap fastener or fasteners.

In a more detailed embodiment of this invention, a window is provided which includes a support structure containing a sill and a pair of vertical jambs. This window further includes upper and lower sashes disposed in adjacent tracks for sliding movement along the jambs. The lower sash includes a hinge for permitting it to tilt out from the support structure. To improve this tilt window, a pair of tilt latch devices are mounted to a rail portion of the lower sash for selectively latching the lower sash within a first set of the adjacent tracks. These tilt latch devices include integral snap fastener portions disposed to secure said devices to the rail portion.

A BRIEF DESCRIPTION OF THE DRAWINGS

Figure 2:
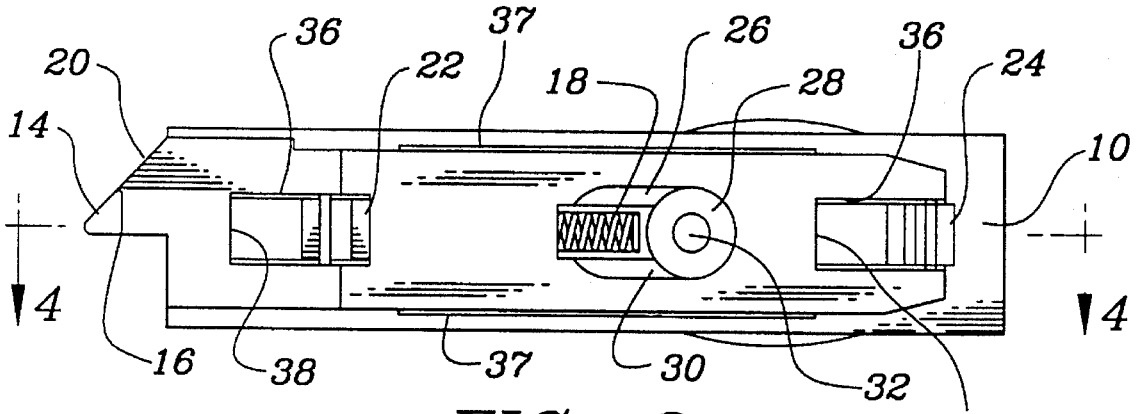
Figure 3:
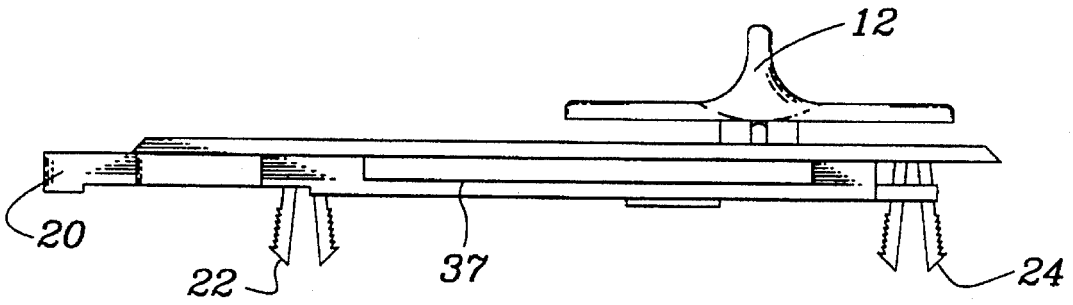
Figure 4:
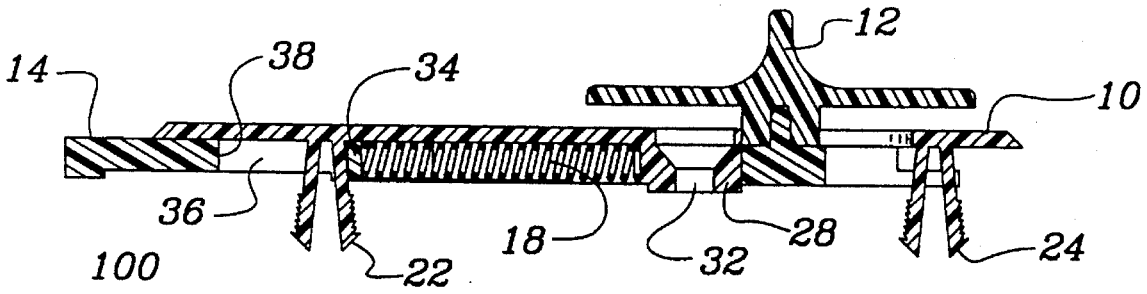
Figure 6:
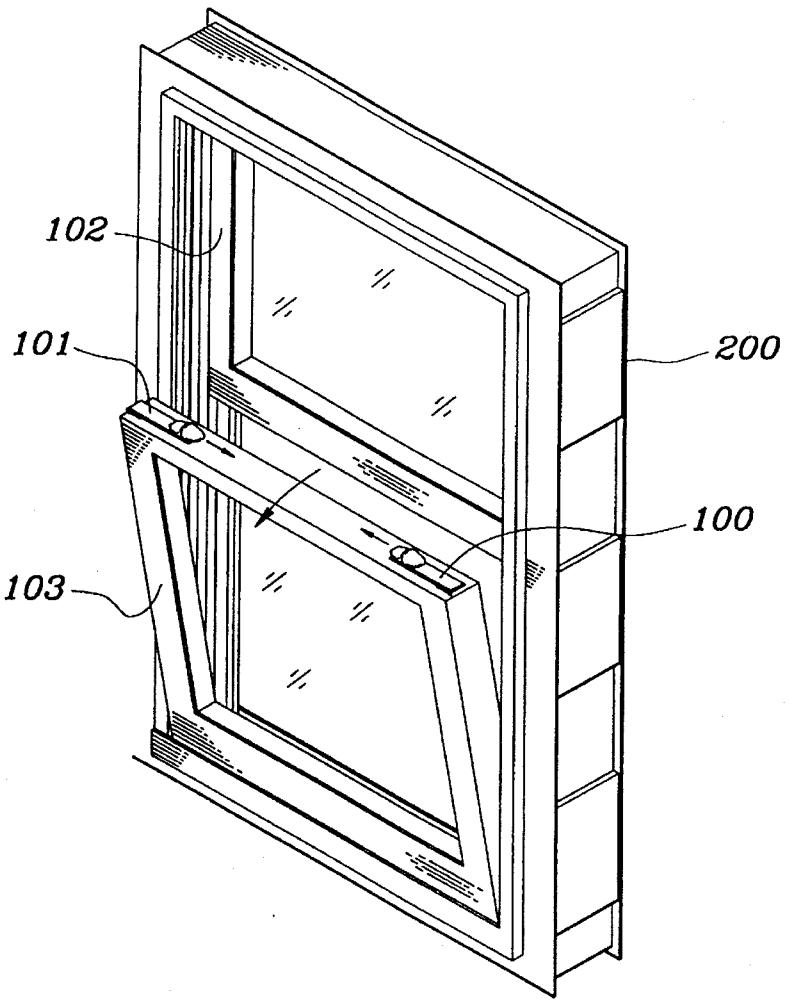
Figure 5:
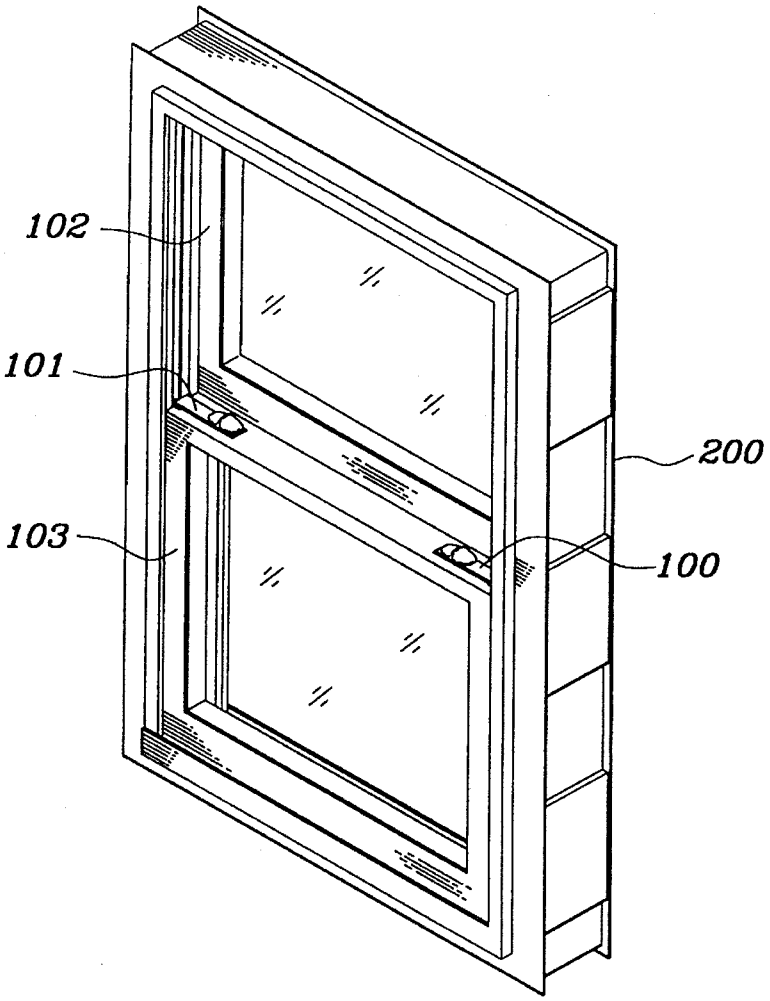

The accompanying drawings illustrate preferred embodiments of the invention as well as other information pertinent to the disclosure, and in which:

FIG. 1: is a front perspective view of a preferred tilt latch device of this invention;

FIG. 2: is a bottom plan view of the tilt latch device of FIG. 1;

FIG. 3: is a side plan view of the tilt latch device of FIG. 1;

FIG. 4: is a cross-sectional, side view of the tilt latch device of FIG. 1;

FIG. 5: is a front perspective view of a double-hung window incorporating a pair of tilt latch devices of this invention in the lower sash; and FIG. 6: is the double-hung window of FIG. 4, after the tilt latch devices have been released from their respective tracks and the lower sash is tilted away from the window support structure.

A DETAILED DESCRIPTION OF THE INVENTION

This invention provides tilt latch devices for reducing the number of parts and lowering the cost of tilt-out windows. Such devices take advantage of specially designed snap fasteners which eliminate labor and material costs.

With respect to the figures and more particularly to FIGS. 1–4 thereof, the preferred tilt latch device 100 of this invention will now be described. This device includes a housing 10 having an opening in its top surface which receives a thumb button 12. Located within the housing 10 is a preferred spring-loaded latch member 14 disposed partially within latch cavity 26. It is known that other materials can be used instead of a metal spring, for example, a rubber or polymeric resilient member.

The latch member 14 of this invention ideally has several features which permit it to operate efficiently in a tilt-out window. In the preferred embodiment, as shown through the oval aperture 30 in FIG. 2, the latch member 14 includes a spring retainer 34 containing a spring 18. Latch member 14 is permitted to slide along a preselected latch track 36, described as a pair of rectangular openings through the longitudinal end regions of latch member 14. This motion compresses spring 18 between the spring retainer 34 and optional screw post 28 until the end stop 38 comes into contact with snap fastener 22. Similar contact can be made between end stop 39 and snap fastener 24. Accordingly, the snap fasteners 22 and 24 ideally have a dual-purpose, in that they assist in fastening the housing 10 to a window surface and also assist in limiting the linear motion of the latch member 14 as it moves back and forth along its latch track 36.

Preferably, the snap fasteners 22 and 24 are disposed so that they compress along the motion direction of the latch member 14.

The housing can include several different functional portions in a one-piece, molded construction. For example, the screw post 28 or snap fasteners 22 and 24, or all three of these elements, can be molded together with the housing 10. As the latch member 14 is compressed against the screw post 28, the snap fasteners 22 and 24 retain the housing 10 and post 28 in a fixed position relative to the rail of the lower sash. This keeps the tilt latch device from moving or shifting during the motion of the latch member 14 into and out of the housing 10. In one preferred embodiment, as shown in FIGS. 5 and 6, a supporting channel 107 is provided for distributing the load caused by the operation of the spring 18 and latch member 14. This alleviates stresses incident upon the snap fasteners 22 and 24, and helps to permit them to function longer without failure. Preferably, the supporting channel supports the housing 10 right below the rectangular upper cover portion.

Other functional portions that can be molded within the housing are the ridges 37.

With respect to FIG. 4, it will become apparent that this device can be fabricated with a small number of moving parts. Specifically, the housing 10 is shown as a one piece construction including both snap fasteners 22 and 24 and the optional screw post 28. The screw post could be used in conjunction with the snap fasteners 22 and 24 by inserting a screw through screw hole 32. As with snap fasteners 22 and 24, screw post 28 has a dual use, permitting the addition of another fastener, and also operating as an end stop for the spring 18. The cross-sectional view of FIG. 4, also illustrates how the thumb button 12 is mounted to an extending portion of the spring retainer 34 which is inserted through a slot in the top of the housing 10.

With reference to FIGS. 5 and 6, a preferred window 200 of this invention will now be described. The window includes a frame structure containing a double-hung arrangement, although single- and triple-hung windows are also contemplated. An upper sash 102 and lower sash 103 are provided in adjacent tracks for sliding movement along the jambs of the frame. On the top surface of the lower sash, or rail, is provided a pair of tilt latch devices 100 and 101 having latch members disposed in the supporting channel on the lower sash 103. (The channel is shown in phantom, since a color-matching cover is placed over it to provide a more aesthetic appearance.) The lower sash 103 can be tilted outward for cleaning or adjusting the screen, etc., by applying pressure to the thumb button portions and pressing them in the direction of the middle of the lower sash 103. This releases the latch contact surface 16 from the inside of the jamb tracks, permitting the window to tilt outward as shown in FIG. 6. To return the window into its original position, the thumb buttons can be re-engaged to compress the spring and withdraw the latch member 14 into the latch cavity 26. In the event the latch member 14 is not compressed completely, the bevelled sliding surface 20 facilitates the closing of the window 200 without damage to the device.

From the foregoing, it can be realized that this invention provides improved tilt latch devices which can be mounted to the rail of a lower sash of a double-hung window inexpensively without a loss in performance. The tilt latch devices of this invention eliminate up to six threaded fasteners per window, which will tend to make them easier to assemble and more affordable. Although various embodiments have been illustrated, this was for the purpose of describing, but not limiting the invention. Various modifications, which will become apparent to one skilled in the art, are within the scope of the invention described in the attached claims.

What is claimed is:

1. In a window having a support structure including a sill and a pair of vertical jambs, said window including a framed glass panel hinged to said support structure so as to permit said panel to swing out from said support structure in a first direction, the improvement comprising:

a tilt latch device mounted to a framed portion of said panel for selectively latching said panel within said support structure, said tilt latch device comprising an integral snap fastener portion disposed to secure said device to said flamed portion and at least one ridge.

2. The window of claim 1 wherein said tilt latch device comprises a second integral snap fastener.

3. The window of claim 1 wherein said integral snap fastener portion is disposed to limit a degree of motion for a latch portion of said tilt latch device.

4. The window of claim 3 wherein said tilt latch device comprises a molded housing portion having a latch cavity disposed therein.

5. The window of claim 4 wherein said tilt latch device comprises a spring loaded latch member disposed to at least fit partially within the latch cavity.

6. The window of claim 1 wherein said integral snap fastener portion comprises a split plastic fastener.

7. The window of claim 1 wherein said tilt latch device comprises a housing which is injection molded to form said integral snap fastener portion thereon.

8. The window of claim 1, wherein said integral snap fastener portion is disposed so that it compresses in a second direction substantially perpendicular to said load.

9. A window tilt latch device for mounting within a channel of a framed, hinged glass panel, said tilt latch device comprising a housing for being substantially disposed in a first direction within said channel, wherein said housing comprises at least one ridge;

a latch member disposed to extend selectively from said housing; and a snap fastener disposed to secure said housing to a first surface of said framed, hinged glass panel.

10. The tilt latch device of claim 9 further comprising a second snap fastener.

11. The tilt latch device of claim 9 wherein said latch member is spring loaded and further comprises a latch contact surface and bevelled sliding surface disposed thereon.

12. The tilt latch device of claim 9 wherein said latch member comprises an aperture therethrough for providing a track for linear motion, said track having a transverse end.

13. The tilt device of claim 12 wherein said latch member comprises an end stop portion located at the transverse end of said track.

14. The tilt latch device of claim 9 wherein said snap fastener and said housing comprise a molded plastic, one-piece construction.

15. The tilt latch device of claim 9, wherein said integral snap fastener is disposed so that it compresses in said first direction.

16. In a window having a support structure including a sill and a pair of vertical jambs, said window including an upper and a lower sash disposed in adjacent tracks for sliding movement along said jambs, said lower sash capable of tilting out from said support structure in a first direction, the improvement comprising:

a pair of tilt latch devices mounted within a supporting channel formed in a rail portion of said lower sash, said tilt latch devices positioned for selectively latching said lower sash within a first set of said adjacent tracks, said tilt latch devices comprising integral snap fastener portions disposed to secure said devices to said rail portion and at least one ridge, said supporting channel helping to distribute a load exerted on said integral snap fastener portions, said load being created by the use of said tilt latch devices.

17. The window of claim 16 wherein said devices comprise a latch cavity including a spring-loaded latch member disposed therein.

18. The window of claim 16 wherein each of said tilt latch devices comprises a housing having said integral snap fastener portion disposed on a lower portion thereof, and a sliding button located on an opposite side of said housing from said snap fastener portion.

19. The window of claim 16 wherein each of said tilt latch devices comprises a pair of integral snap fasteners molded to a remaining portion of said tilt latch devices.

20. The window of claim 16, wherein said integral snap fastener portions are disposed so that they compress in a second direction substantially perpendicular to said first load.

21. A window tilt latch device for mounting to a framed, hinged glass panel, said tilt latch device comprising:

a housing;

a latch member disposed to movably extend selectively from said housing, said latch member further comprising an aperture therethrough for providing a track for linear motion, said track having a transverse end, and an end stop portion located at the transverse end of said track; and a snap fastener disposed to secure said housing in said first direction to a first surface of said framed, hinged glass panel, said snap fastener further comprising a first surface for contacting said end stop.

22. A window tilt latch device for mounting to a framed, hinged glass panel, said tilt latch device comprising a housing substantially disposed in a first direction;

a latch member disposed to extend selectively from said housing; and a snap fastener disposed to secure said housing to a first surface of said framed, hinged glass panel, wherein said snap fastener is disposed so that it compresses in the first direction.

* * * * *